United States Patent [19]

Iida et al.

[11] Patent Number: 4,952,122

[45] Date of Patent: Aug. 28, 1990

[54] FLUID COMPRESSOR

[75] Inventors: Toshikatsu Iida, Yokohama; Takayoshi Fujiwara, Kawasaki, both of Japan

[73] Assignee: Kabushiki Kaisha Toshiba, Kawasaki, Japan

[21] Appl. No.: 376,530

[22] Filed: Jul. 7, 1989

[30] Foreign Application Priority Data

Jul. 8, 1988 [JP] Japan ..... 63-170694

[51] Int. Cl.[5] ..... F04B 29/00

[52] U.S. Cl. ..... 417/356; 418/220

[58] Field of Search ..... 417/356; 418/220; 415/71, 72, 73

[56] References Cited

U.S. PATENT DOCUMENTS

| | | | |
|---|---|---|---|
| 2,312,848 | 3/1943 | Pezzillo | 417/356 |
| 2,401,189 | 5/1955 | Quiroz . | |
| 3,240,155 | 3/1966 | Quiroz | 418/220 X |
| 3,972,653 | 8/1976 | Travis et al. | 417/356 |
| 4,871,304 | 10/1989 | Lida et al. | 417/356 X |
| 4,875,842 | 10/1989 | Lida et al. | 418/220 |

*Primary Examiner*—John C. Fox

*Attorney, Agent, or Firm*—Cushman, Darby & Cushman

[57] ABSTRACT

A fluid compressor includes a cylindrical casing, a cylinder arranged in the casing to be rotatable and coaxial with the casing, and a columnar rotary body located in the cylinder and extending in the axial direction of the cylinder. A spiral groove is formed on the outer circumferential surface of the rotating body. A spiral blade is fitted into the groove and divides the space between the inner circumferential surface and the outer circumferential surface into a plurality of operating chambers which have volumes gradually decreasing with a distance from one end of the cylinder. When the cylinder and rotary body are relatively rotated by a motor section, a fluid, introduced into the one end of the cylinder, is transferred toward the other end of the cylinder through the operating chambers and compressed during the transfer. The motor section includes an annular stator fixed to the outer circumferential surface of the casing, and a rotor located within the casing and fixed to the outer circumferential surfaces of the cylinder to be coaxial with the casing.

6 Claims, 3 Drawing Sheets

FLUID COMPRESSOR

BACKGROUND OF THE INVENTION

1. Field of the Invention

The present invention relates to a fluid compressor and, more particularly, to a fluid compressor for compressing a refrigerant gas in a refrigeration cycle, for example.

2. Description of the Related Art

Various conventional compressors such as a reciprocating compressor and a rotary compressor are known to those skilled in the art. In these conventional compressors, the structure of both the compression section and drive unit, such as a crankshaft for transmitting rotational force to the compression section, are complex, and a large number of components are required. In addition, in order to improve compression efficiency in a conventional compressor, a check valve must be arranged on its delivery side. However, the pressure difference between the inlet and outlet sides of the check valve is large, and gas tends to leak from the check valve, degrading the compression efficiency. In order to solve this problem, high dimensional precision of the constituting components and high assembly precision must be maintained, thus resulting in high costs.

A crew pump is disclosed in U.S. Pat. No. 2,401,189. In this pump, a columnar rotary member is fitted in a sleeve, and a spiral groove is formed on the surface of the rotary member, into which a spiral blade is slidably fitted. Upon rotation of the rotary member, a fluid, sealed between the adjacent turns of the blade in the space between the outer surface of the rotary member and the inner surface of the sleeve, is transported from one end of the sleeve to the other.

The screw pump can transport the fluid but does not have a function for compressing the fluid. In order to seal the transported fluid, the outer surface of the blade must always be in contact with the inner surface of the sleeve. During rotation of the rotary member, however, the blade itself is deformed in the groove, and it cannot slide easily and smoothly in the groove, and for this reason, it is difficult to keep the outer surface of the blade in slidable contact with the inner surface of the sleeve, therefore it is difficult to satisfactorily seal the fluid. As a result, the compression operation cannot be satisfactorily performed by the structure of the screw pump.

SUMMARY OF THE INVENTION

This invention has been made in consideration of the above situation and has as its object to provide a fluid compressor of a simple construction which enables efficient compression and allows easy manufacture and assembly of component parts.

In order to achieve the above object, a fluid compressor according to this invention comprises a substantially cylindrical casing; a cylinder having a suction side and a discharge side and arranged rotatably in the casing; a columnar rotary body arranged in the cylinder to extend in the axial direction thereof and be eccentric thereto, and rotatable relative to the cylinder while part of the rotary body is in contact with the inner circumferential surface of the cylinder, the rotary body having a spiral groove formed on the outer circumferential surface thereof and having pitches narrowed gradually with a distance from the suction side toward the discharge side of the cylinder; a spiral blade fitted in the groove to be slidable, substantially in the radial direction of the rotary body, having an outer surface in tight contact with the inner circumferential surface of the cylinder, and dividing the space between inner circumferential surface of the cylinder and the outer circumferential surface of the rotary body into a plurality of operating chambers; and drive means, including a stator fixed to the outer circumferential surface of the casing and a rotor located within the casing and fixed to the cylinder, for relatively rotating the cylinder and the rotary body to sequentially transport a fluid, which is drawn in the cylinder through the suction end of the cylinder, through the operating chambers to the discharge side.

BRIEF DESCRIPTION OF THE DRAWINGS

FIGS. 1 through 6D show a fluid compressor according to an embodiment of this invention; in which FIG. 1 is a sectional view showing the whole compressor;

FIG. 2 is a perspective view of the rotor body;

FIG. 3 is a perspective view of a blade;

FIG. 4 is a sectional view taken along line IV—IV of FIG. 1;

FIGS. 6A through 6D are sectional views each showing the relative position of the cylinder and the rotary body in a phase of the compression process.

DETAILED DESCRIPTION OF THE PREFERRED EMBODIMENT

Embodiments of this invention will now be described with reference to the accompanying drawings.

Figure 1:
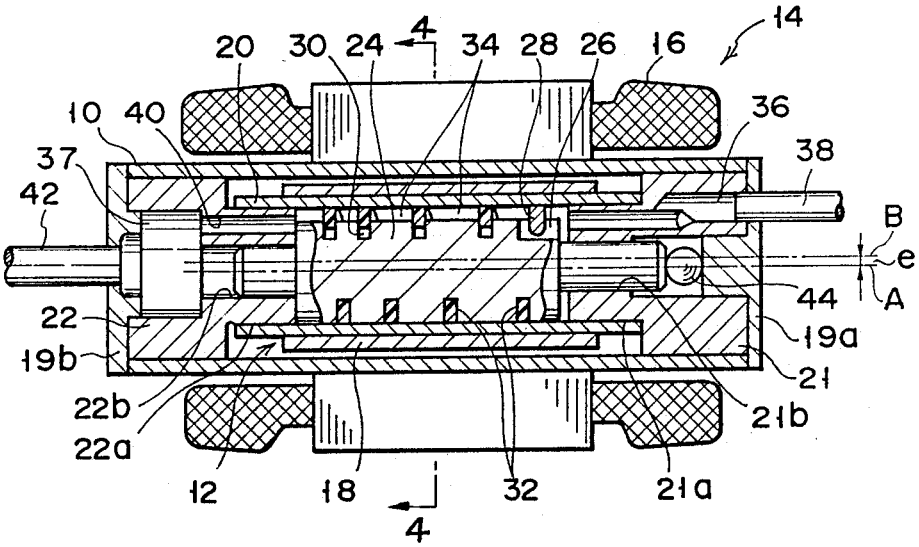

FIG. 1 shows an embodied example in which this invention is applied to a compressor for compressing a refrigerant gas in a refrigeration cycle.

The compressor comprises cylindrical casing 10, compression section 12 located in the casing and electric motor section 14 serving as a drive means for driving the compression section. Motor section 14 includes annular stator 16 fixed to the outer circumferential surface of casing 10 and annular rotor 18 provided inside stator 16 in the casing. Rotor 18 is provided in casing 10 coaxially with each other and the outer circumferential surface of rotor 18 faces the inner circumferential surface of casing 10 separated a certain distance from each other. Since there is a motor gap, including the gap and the wall of casing 10, between each stator 16 and rotor 18, it is desirable to use a DC motor for the motor section.

Compression section 12 has cylinder 20 provided in casing 10 and rotor 18 is coaxially fixed to the outer circumferential surface of the cylinder. Both ends of cylinder 20 is rotatably supported and airtightly closed by bearings 21 and 22 fixed to the ends of casing 10. The right end portion, or the suction end, of cylinder 20 is rotatably fitted on peripheral surface **21*a* of bearing 21 and the left end portion, or the discharge-end, of cylinder 20 is rotatably fitted on peripheral surface 22*a* of bearing 22. Thus, cylinder 20 and rotor 18 fixed thereto are supported coaxially with stator 16 and casing 10 by bearings 20 and 21**.

Casing 10 has end plates 19*a* and 19*b*, fixed to the opposite end thereof, so that both ends of the casing are closed airtight by these end plates and the bearings.

In cylinder 20, columnar rotary rod 24, the diameter of which is smaller than the inner diameter of the cylinder, is arranged in the axial direction of the cylinder. Rod 24 is located with its central axis A eccentric by the distance "e" with respect to the central axis B of cylinder 20 and part of rod 24 is in contact with the inner circumferential surface of cylinder 20. The right end portion of rod 24 is rotatably inserted in bearing hole 21*b* formed in bearing 21 and the left end portion of rod 24 is rotatably inserted in bearing hole 22*b* of bearing 22. These bearing holes 21*b* and 22*b* are formed coaxial with each other and are eccentric by the distance "e" to the axis of cylinder 20. Therefore, rod 24 is rotatably supported at a specified position with respect to cylinder 20 by bearings 21 and 22.

As is shown in FIG. 1, engage groove 26 is formed in the outer circumferential surface at the right end portion of rod 24. In this groove, driving pin 28 protruding from the inner surface of cylinder 20 is fitted movably in the radial direction of the cylinder. Therefore, when motor section 12 is energized to rotate rotor 18 along with cylinder 20, the rotational force of cylinder 20 is transmitted through pin 28 to rod 24. Consequently, rod 24 is made to rotate in cylinder 20 with a part thereof in contact with the inner circumferential surface of the cylinder.

Figure 2:
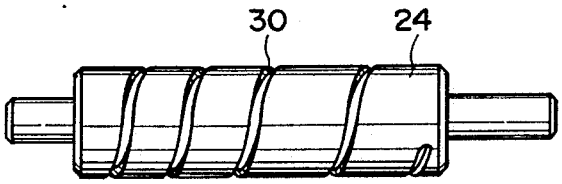
Figure 3:
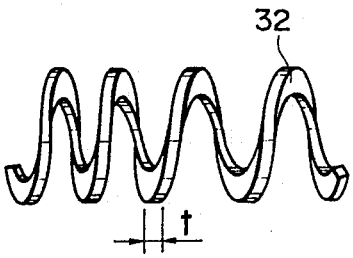
Figure 4:
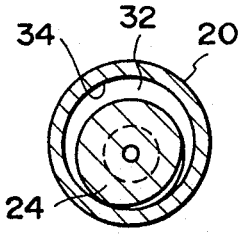
Figure 5A:
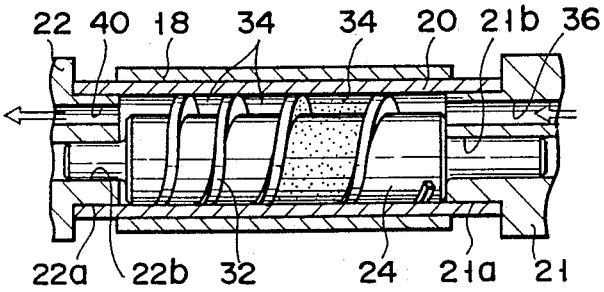
FIGS. 5A through 5D are sectional views each showing a phase of the compression process of a refrigerant gas.
Figure 6A:
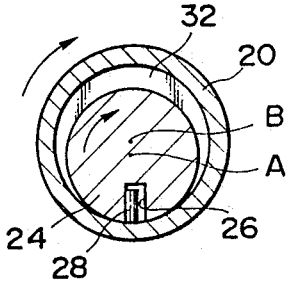
Figure 5B:
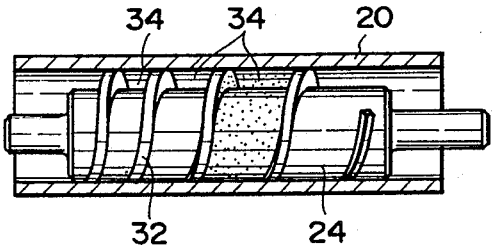
Figure 6B:
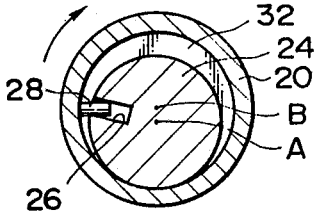
Figure 5C:
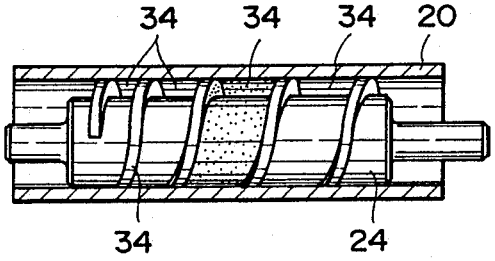
Figure 6C:
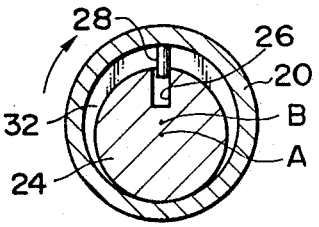
Figure 5D:
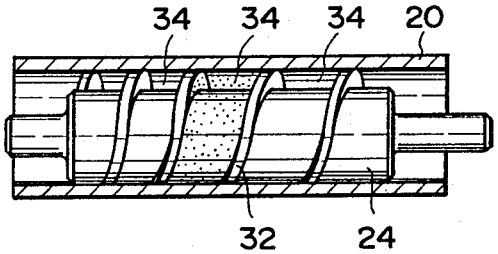
Figure 6D:
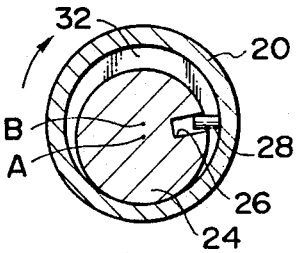

As is shown in FIGS. 1 and 2, spiral groove 30 is formed on the outer circumferential surface of rotary rod 24, extending between the opposite ends of the rod. As is apparent from FIG. 2, groove 30 has pitches gradually narrowed with a distance from the right end toward the left end of cylinder 20, that is to say, from the suction side toward the discharge side of the cylinder. Spiral blade 32, shown in FIG. 3, is fitted in groove 30. The thickness of blade 32 is almost the same as the width of groove 30 and any part of blade 32 is movable through groove 30 in the radial direction of rod 24. The outer circumferential surface of blade 32 slides on the inner circumferential surface of the cylinder 20 while it is in close contact therewith. Blade 32 is formed of an elastic material such as Teflon (trademark) and is fitted in groove 30 by utilizing the elasticity of the material.

The space between the inner circumferential surface of cylinder 20 and the outer circumferential surface of rod 24 is divided into a plurality of operating chamber 34 by blade 32. Each operating chamber 34 is defined by two adjacent turns of blade 32 and is in a generally crescent form extending along the blade from one contact point between rod 24 and the inner circumferential surface of cylinder 20 to the next contact point. The volumes of operating chambers 34 are reduced gradually with a distance from the suction side to the discharge side of cylinder 20.

As is shown in FIG. 1, suction hole 36 is bored through bearing 21, extending in parallel to the axis of cylinder 20. One end of suction hole 36 is open to the end portion of the suction side of cylinder 20 and the other end is connected to suction tube 38 of the refrigeration cycle. Discharge hole 40 is formed in bearing 22 along the axis of cylinder 20. One end of discharge hole 40 is open to the end portion of the discharge side of cylinder 20 and the other end is open to chamber 37 formed in bearing 22. To this chamber 37, discharge tube 42 of the refrigeration cycle is connected, the discharge tube being fixedly supported by end plate 19*b* of casing 10.

In FIG. 1, numeral 44 denotes a ball accommodated in hole 21*b* of bearing 21. This ball is in contact with the right end of rod 24 and acts as a thrust bearing.

The operation of the thus constructed compressor will now be described.

When electric motor section 12 is energized, rotor 18 is rotated and cylinder 20 rotates together therewith. At the same time, rotary rod 24 is rotated while part of its outer circumferential surface is in contact with the inner circumferential surface of cylinder 20. These relative rotary motions of rod 24 and cylinder 20 are maintained by regulating means including pin 28 and engaging groove recess 26. In addition, blade 32 rotates integrally with rod 24.

Blade 32 rotates with its outer circumferential surface in contact with the inner circumferential surface of cylinder 20. Therefore, each part of blade 32 is pushed successively into groove 30 as it comes closer to each contact point between the outer circumferential surface of rod 24 and the inner circumferential surface of cylinder 20 and emerges from groove 30 as it goes away from the contact point. Meanwhile, as compression section 12 is operated, a refrigerant gas is drawn into cylinder 20 through suction tube 38 and suction hole 36. This gas is first confined in operating chamber 34 nearest to the suction end of cylinder 20. As is shown in FIGS. 5A through 5D and 6A through 6D, as rotary rod 24 rotates, the gas, while confined between two adjacent turns of blade 32, is transferred to successive operating chambers 43 toward the discharge side. The volumes of operating chambers 34 decrease gradually with a distance from the suction side to the discharge side of cylinder 20, so that the refrigerant gas is compressed gradually as it is sent to the discharge end. The compressed gas passes through discharge port 40 in bearing 22 and is discharged into chamber 37, then returned through discharge tube 42 to the refrigeration cycle.

In the compressor constructed as described above, groove 30 of rotary rod 24 is formed such that its pitches become gradually narrower with a distance from the suction end to the discharge end of cylinder 20. Thus, the volumes of operating chambers 34, divided by blade 32, are reduced gradually with a distance from the suction side. Therefore, the refrigerant gas can be compressed as it is being transferred from the suction side to the discharge side of cylinder 20. Since the refrigerant gas is transferred and compressed while confined within operating chamber 34, compression efficiency is good in this embodiment even if no discharge valve is provided on the discharge side of the compressor.

Since there is no need of a discharge valve , it is possible to simplify the construction of the compressor and reduce the quantities of parts in number. Further, because rotor 18 of electric motor section 12 is supported by cylinder 20 of compression section 14, it is not necessary to provide a rotary shaft and bearings exclusively for supporting the rotor. This makes it possible to further simplify the construction of the compressor and reduce the amount of parts.

Cylinder 20 and rotary rod 24 are partially in contact with each other while they are rotated in the same direction. Therefore, the friction between these two members is so small that they can rotate smoothly with less vibration and noise.

The feeding capacity of a compressor is determined by the first pitch of blade 32, that is, by the volume of operating chamber 34 nearest to the suction-side end of cylinder 20. According to this embodiment, the pitches of blade 32 gradually narrow with a distance from the suction side to the discharge side of cylinder 20. If the number of turns of blade 32 is fixed, therefore, the first pitch of the blade and hence, the feeding capacity of the compressor, according to this embodiment, can be made greater than that of a compressor whose blade has regular pitches throughout the length of its rotary member. In other words, it is possible to realize a compressor which exhibits a high compression efficiency.

According to this embodiment, bearings 21 and 22 which support the opposite ends of cylinder 20 are fitted at opposite ends of cylindrical casing 10. Therefore, when bearings 21 and 22 are mounted in casing 10, the axes of the two bearings can be accurately aligned. As a result, even if the machining accuracy of the inner circumferential surface of casing 10 is at about the same level as that of a conventional compressor, for example, both bearings 21 and 22 can be aligned with high accuracy.

Stator 16 of motor section 14 is located outside casing 10, so that casing 10 has only to be formed in such a size as can hold rotor 18 and cylinder 20 inside it. Therefore, it is possible to make the compressor in a smaller size than compressors having a closed case containing motor section 14 and the whole body of compression section 12, and it is also possible to compose what is called a canned motor type compressor.

Furthermore, since bearings 21 and 22 are provided at the opposite sides of motor section 14 and compression section 12, the forces acting on the bearings during operation cancel each other out. In consequence, the load applied to bearings 21 and 22 is small, which makes it possible to use smaller bearings. Therefore, the compressor can be further reduced in size.

This invention is not limited to the above embodiment and various changes and modifications may be made in the invention without departing from the spirit and scope thereof.

Figure 7:
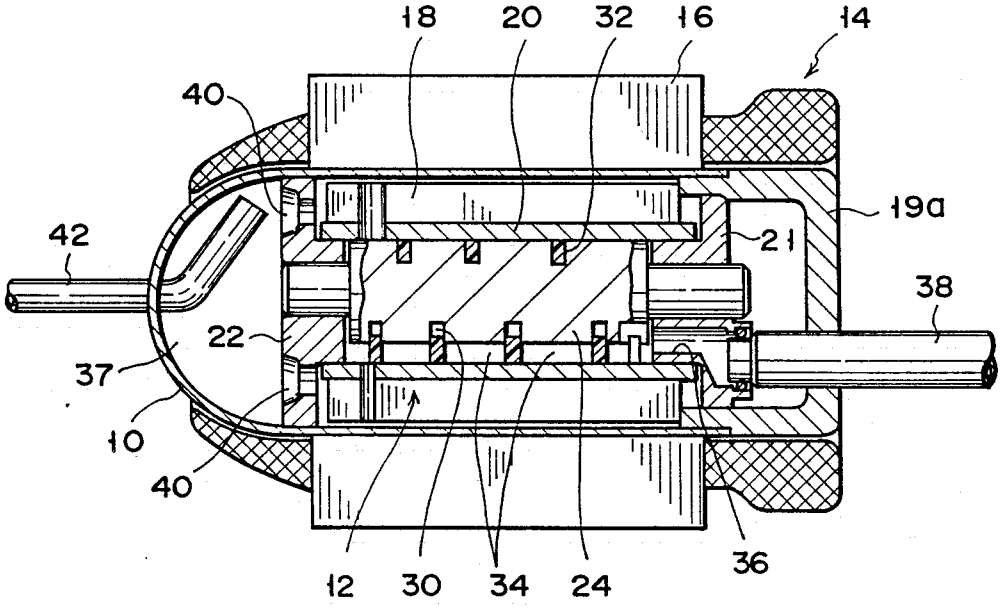
FIG. 7 is a sectional view of the whole of a fluid compressor according to a second embodiment of this invention.

For example, as is shown in FIG. 7, casing 10 may be formed by drawing and one end thereof may be closed in a spherical shape. In this case, however, the portion of the casing between bearings 21 and 22 is formed in a cylindrical shape to enable easy alignment of bearings 21 and 22.

The fluid compressor in accordance with this invention can be applied to compression of not only refrigerant gas but also other types of fluid.

What is claimed is:

1. A fluid compressor comprising:

a substantially cylindrical casing;

a cylinder having a suction end and a discharge end and arranged rotatably in said casing;

a columnar rotary body located in the cylinder to extend in the axial direction thereof and be eccentric thereto, and rotatable relative to the cylinder while part of the rotary body is in contact with the inner circumferential surface of the cylinder, said rotary body having a spiral groove formed on the outer circumferential surface thereof, said groove having pitches narrowed gradually with a distance from the suction end toward the discharge end of said cylinder;

a spiral blade fitted in the groove to be slidable, substantially in the radial direction of the rotary body, having an outer surface in tight contact with the inner circumferential surface of the cylinder, and dividing the space between the inner circumferential surface of the cylinder and the outer circumferential surface of the rotary body into a plurality of operating chambers; and drive means, including a stator fixed to the outer periphery of the casing and a rotor located within the casing and fixed to the cylinder, for rotating the cylinder and the rotary body to sequentially transport a fluid, drawn in the cylinder through the suction end thereof, through the operating chambers to the discharge end of the cylinder.

2. A fluid compressor according to claim 1, which further comprises a first bearing fitted in one end of said casing and rotatably supporting the suction end of the cylinder, and a second bearing fitted in the other end of the casing and supporting the discharge end of the cylinder, and wherein said cylinder is supported by the first and second bearings, coaxially with the casing and separated by a specified distance from the inner circumferential surface of the casing.

3. A fluid compressor according to claim 2, wherein said rotor is formed in an annular shape, is fixed coaxially to the outer circumferential surface of said cylinder, and is separated by a specified distance from the inner circumferential surface of said casing.

4. A fluid compressor according to claim 2, wherein said rotary body has one end rotatably supported by said first bearing and the opposite end rotatably supported by said second bearing.

5. A fluid compressor according claim 4, wherein each of said first and second bearings has an outer peripheral surface onto which the corresponding end of said cylinder is rotatably fitted, and a bearing hole into which the corresponding end of said rotary body is rotatably inserted.

6. A fluid compressor according to claim 2, wherein said first bearing has a suction hole for guiding a fluid into the suction end portion of the cylinder, and said second bearing has a discharge hole for discharging the fluid compressed in said cylinder to the outside of said casing.

* * * * *